US006185956B1

(12) United States Patent
Brasz

(10) Patent No.: US 6,185,956 B1
(45) Date of Patent: Feb. 13, 2001

(54) SINGLE ROTOR EXPRESSOR AS TWO-PHASE FLOW THROTTLE VALVE REPLACEMENT

(75) Inventor: Joost J. Brasz, Fayetteville, NY (US)

(73) Assignee: Carrier Corporation, Farmington, CT (US)

( * ) Notice: Under 35 U.S.C. 154(b), the term of this patent shall be extended for 0 days.

(21) Appl. No.: 09/350,520

(22) Filed: Jul. 9, 1999

(51) Int. Cl.[7] ..... F25B 1/00

(52) U.S. Cl. ..... 62/498; 62/116; 417/391; 417/406

(58) Field of Search ..... 62/116, 197, 498; 417/391, 406

(56) References Cited

U.S. PATENT DOCUMENTS

| | | | | |
|---|---|---|---|---|
| 1,866,825 | * | 7/1932 | Smith | 62/116 |
| 3,432,089 | * | 3/1969 | Schibbye | 62/498 |
| 4,235,079 | * | 11/1980 | Masser | 62/116 |
| 4,820,135 | * | 4/1989 | Simmons | 417/391 |
| 5,167,491 | | 12/1992 | Keller, Jr. et al. | 417/28 |
| 5,192,199 | | 3/1993 | Olofsson | 417/406 |
| 5,467,613 | | 11/1995 | Brasz | 62/402 |
| 5,544,496 | * | 8/1996 | Stoll et al. | 62/498 |
| 5,833,446 | * | 11/1998 | Smith et al. | 62/116 |
| 5,871,340 | * | 2/1999 | Hatton | 417/406 |
| 5,911,743 | | 6/1999 | Shaw | 62/84 |

OTHER PUBLICATIONS

"Improving the Refrigeration Cycle With Turbo–Expanders", J.J. Brasz, 19th International Congress of Refrigeration (1995) Proceedings vol. IIIa, pp. 246–253.

"The Expressor: An Efficiency Boost to Vapour Compression Systems By Power Recovery From the Throttling Process", Ian K. Smith and Nikola R. Stosic, AES–vol. 34, Heat Pump and Refrigeration Systems Design, Analysis and Applications ASME 1995, pp. 173–181.

"Development of the Trilateral Flash Cycle System Part 3: The Design of High Efficiency Two–Phase Screw Expanders", IK Smith et al., Proc Instn Mch Engrs vol. 210, pp. 75–93.

* cited by examiner

*Primary Examiner*—William E. Tapolcai
(74) *Attorney, Agent, or Firm*—Wall Marjama & Bilinski

(57) ABSTRACT

A positive displacement machine having a set of parallel meshing rotors employed in a compression-expansion refrigeration system receives a fluid refrigerant input from a condenser and expands the fluid in a first zone and forces substantially all of the liquid in the first zone to an evaporator. The remaining fluid from the first zone of the machine is then compressed in an adjacent second zone of the machine to form a high pressure vapor, which is then routed back to the condenser. The positive displacement machine includes a first rotor having a plurality of helical lobes disposed about a rotor periphery. At least one second rotor has a plurality of helical grooves disposed about a second rotor periphery for receiving the lobes of the first rotor during rotation of the rotors in opposite directions. A housing defines a chamber for enclosing the rotors. The plural displacement machine includes an inlet port at one end, an outlet port at an opposing end, and an intermediate port in a side wall of the chamber between the inlet and outlet ports. An effectively closed expanding working chamber is formed between the inlet and intermediate ports, while an effectively closed contracting working chamber is formed between the intermediate and outlet ports.

21 Claims, 9 Drawing Sheets

SINGLE ROTOR EXPRESSOR AS TWO-PHASE FLOW THROTTLE VALVE REPLACEMENT

FIELD OF THE INVENTION

The invention relates to the field of refrigeration, and more particularly to a single positive displacement machine (expressor) which allows for both expansion and compression of a two-phase flow mixture as is employed in chiller, air conditioning, heat pump, or refrigeration systems.

BACKGROUND OF THE INVENTION

First and referring to FIG. 1, a known refrigeration system 10 for a heat pump, refrigerator, chiller or air conditioner is shown schematically for background purposes. The known refrigeration system 10 includes a compressor 11, driven by an electric motor 12 or other known means, that compresses vapor. The compressor 11 discharges compressed vapor, at high pressure and high temperature, into a condenser 13 where heat is extracted from the working fluid, causing condensation of the high pressure vapor into high pressure liquid. The high pressure liquid then flows from the condenser 13 into a throttling valve 14 which reduces the pressure of the liquid, causing partial flashing. This lower pressure fluid is then routed into an evaporator 15 in which the fluid absorbs heat, thereby converting the working fluid from the liquid to the vapor state. The vapor from the evaporator reenters the compressor 11 on the intake side.

FIG. 2 shows a vapor compression cycle PH (pressure v. enthalpy) diagram for the conventional refrigeration system shown in FIG. 1. with pressure (P) represented along the ordinate and enthalphy (H) appearing along the abscissa. The vapor/compression cycle shows an adiabatic compression of vapor along line A, superheated cooling of the vapor occurring along line B1, followed by biphase isothermal condensation along line B2, and liquid subcooling along line B3. When the working fluid passes through a throttling valve, the working fluid undergoes isoenthalpic expansion, as indicated by vertical line C. Isobaric evaporation of the liquid in the evaporator is shown by horizontal line D.

As should be apparent from the preceding diagram, and with isoenthalpic expansion, the quality of the expanded refrigerant is increased because some of the compression energy of the condensed working fluid is consumed in transforming the liquid into vapor at the low pressure side of the system. For efficient operation, the quality of the working fluid; that is, the vapor fraction of the expanded refrigerant, should be as small as possible.

Referring to FIG. 3, an improved system has been developed, as described in commonly owned U.S. Pat. No. 5,467,613, in which a turbine expander 17 is substituted for the throttling valve expander. The turbine expander 17 receives the high pressure liquid from the condenser and drives a turbine rotor with the kinetic energy of the expanding working fluid. In other words, a portion of the energy imparted to the working fluid by the compressor is recovered in the expander as mechanical energy. Therefore, the turbine expander relieves some of the compressor load on the drive motor, so that the refrigeration cycle operates more efficiently than is possible with a throttling type of expander.

Typically, the turbine expander is either mechanically or electrically connected with the main compressor. A typical mechanical arrangement is illustrated in FIG. 3. A disadvantage of the direct coupling arrangement is that the turbine/expander must be placed in close proximity with the main compressor. This results in the need for additional piping in the system and consequently increases the implementation cost of the two-phase flow expander.

Another possible solution to the above problem, shown in FIG. 4, is to provide a stand alone turbine/expander which locally transfers its recovered mechanical power into electrical power through the use of a generator 18. This transferred electrical power supplies a portion of the electrical power that is required to drive the motor 12 of the compressor 11. The disadvantage with this system is the need for the additional electric generator, as well as the additional losses associated with the generator.

In addition, each of the systems shown in FIGS. 3 and 4 require turbine/expanders which are run at fixed speeds. In actual system applications, however, fixed speed operation requires additional hardware to prevent hot gas by-pass from the condenser to the evaporator during part load conditions. As a consequence, the efficiency of existing throttle loss recovery systems deteriorates under part-load conditions. For example, for a system running at or below 50% capacity with reduced temperature lift, it has been found that power recovery of the turbine/expander is typically reduced to almost negligible amounts.

SUMMARY OF THE INVENTION

A primary object of the present invention is to improve the state of the art of throttle loss recovery systems.

Another primary object of the present invention is to improve the efficiency of a refrigeration system, but without requiring additional piping or the need of a generator or other apparatus.

Therefore and according to a preferred aspect of the present invention, there is provided a positive displacement machine comprising:

- a first rotor having a plurality of helical lobes disposed about a rotor periphery;
- at least one second rotor in meshing contact with said first rotor and having a plurality of helical grooves for receiving the lobes of said first rotor during rotation of said rotors in opposite directions; and
- a housing defining a chamber enclosing the rotors and having an inlet port at one end and an outlet port at an opposing end, wherein the housing includes an intermediate port formed in a side wall of the chamber between the inlet port and the outlet port and in that the length of the rotors are sufficient to define during rotation of said first rotor in one direction an effectively closed expanding working chamber between the inlet and intermediate ports and an effectively closed contracting working chamber between the intermediate and outlet ports.

Preferably, a twin screw positive displacement machine (expressor) is provided having a pair of rotors which can be driven without motors, by fluid refrigerant passing through the rotors, though the machine can include a motor drive, if needed.

According to another preferred aspect of the present invention, there is provided a single fluid compression/expansion refrigeration apparatus which comprises;

- a fill of fluid refrigerant that exists in the apparatus as liquid and a vapor;
- a main compressor for compressing the vapor thereby adding compression energy to the refrigerant fluid, said compressor having an inlet to receive the fluid at a predetermined reduced pressure and an outlet from which the fluid is delivered at an elevated pressure;

a drive motor coupled to said main compressor for driving said main compressor;

condenser means for extracting heat from the refrigerant and converting the compressed vapor emerging from said main compressor into a liquid;

evaporator means for absorbing external heat into the refrigerant thereby converting liquid refrigerant into vapor; and a plural rotary displacement machine disposed between said condenser means and an input to said evaporator means, said plural displacement machine comprising:

a first rotor having a plurality of helical lobes disposed about a rotor periphery;

at least one second rotor in meshing contact with said first rotor and having a plurality of helical grooves for receiving the lobes of said first rotor during rotation of said rotors in opposite directions; and a housing defining a chamber enclosing the rotors and having an inlet port at one end and an outlet port at an opposing end, wherein the housing includes an intermediate port formed in a side wall of the chamber between the inlet port and the outlet port and in that the length of the rotors is sufficient to define during rotation of said first rotor in one direction an effectively closed expanding working chamber between the inlet and intermediate ports and an effectively closed contracting working chamber between the intermediate and outlet ports.

An advantage of the present invention is that a plural displacement machine (hereinafter also referred to as an expresser) as described can capably perform both expansion and compression upon an entering subcooled liquid or two-phase fluid mixture.

Another advantage of the present invention is that the expander/compressor (hereinafter also referred to as an expressor) is not coupled directly to a fixed speed device (such as an electric generator or the main compressor or its motor), therefore its speed is variable. Variable speed capability permits reduced speed operation under part load conditions when the liquid mass flow rate entering the expander is reduced. In this manner, the speed of the expresser can be self-regulating.

Another advantage of the present invention is that the expressor is a stand-alone device and does not require separate mechanical connection with the main compressor. Therefore, the expressor can be retrofitted on existing HVAC equipment.

Yet another advantage of the present invention is that the mechanical power recovered during the expansion process can be directly used to drive a compression process. Therefore, the present device is more efficient than stand alone devices which convert mechanical power into electrical power.

Still another advantage is that because a compression process is performed using the expressor which is entirely separate from the main compressor, the overall system capacity is increased.

Yet another advantage is that a single screw plural rotor displacement machine can effectively expand and then compress a portion of an incoming two-phase mixture without requiring a pair of machines for separately expanding and compressing the two-phase mixture.

Still another advantage of the present invention is that there is no size limitation in applications. Therefore, large slow expressors or small fast expressors can be provided.

These and other objects, features, and advantages will become apparent from the following Detailed Description of the Invention which should be read in conjunction with the accompanying drawings.

DETAILED DESCRIPTION OF THE INVENTION

Figure 1:
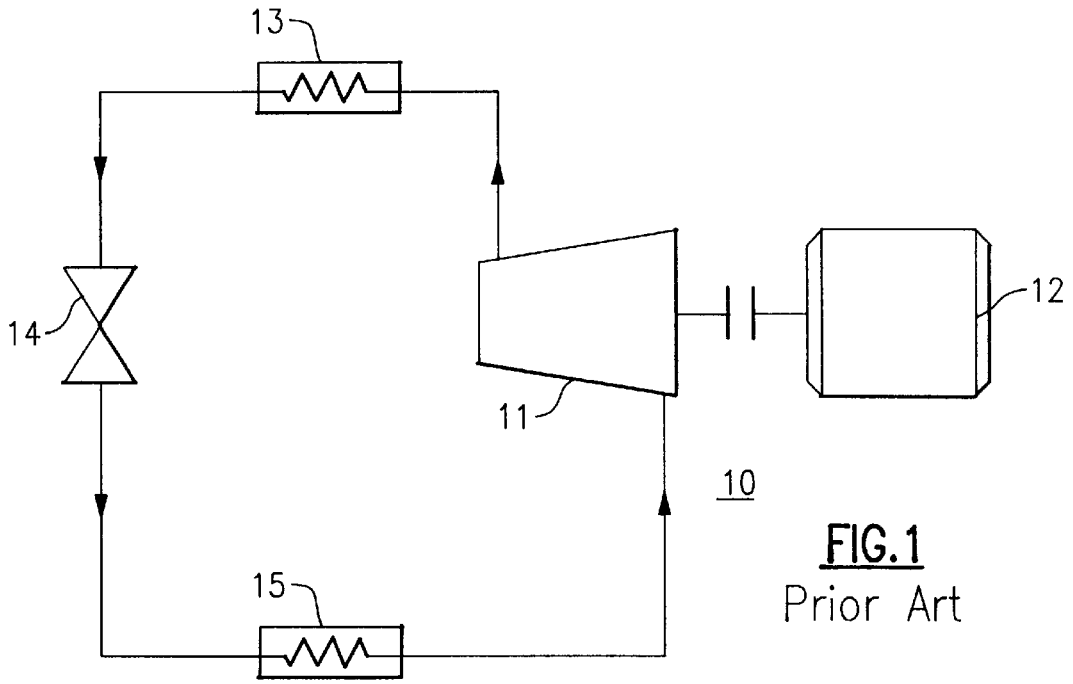
FIG.1 Prior Art
FIG. 1 is a schematic diagram of a known chiller system without throttle-loss power recovery.
Figure 2:
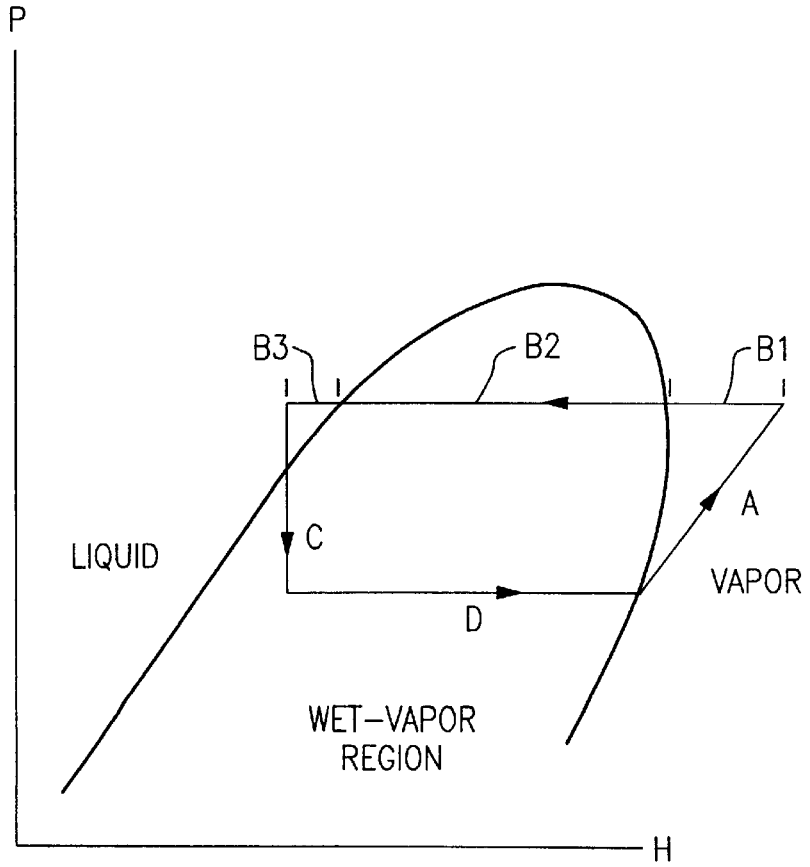
FIG. 2 is a refrigerant compression/expansion cycle chart for the chiller system of FIG. 1.
Figure 3:
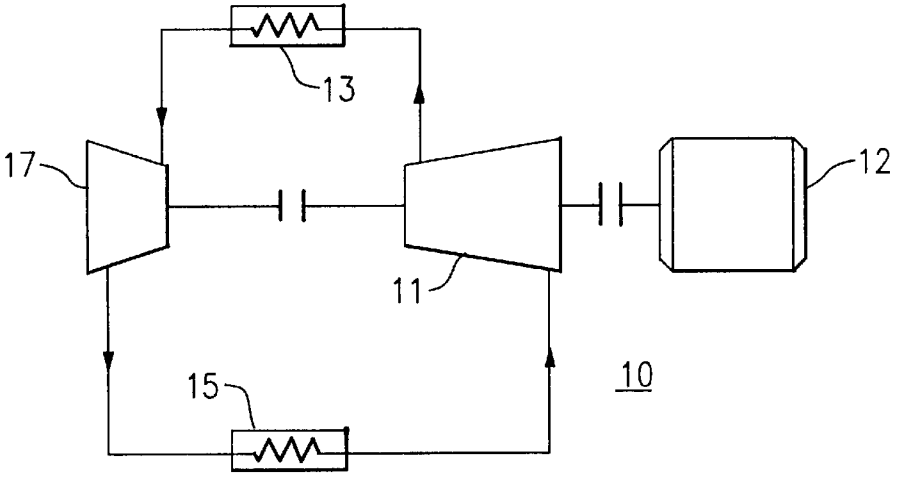
FIG.3 Prior Art
FIG. 3 is a schematic diagram of the known chiller system of FIG. 1 in which the throttling expansion valve is replaced with a turbo-expander which is mechanically coupled to the main compressor.
Figure 4:
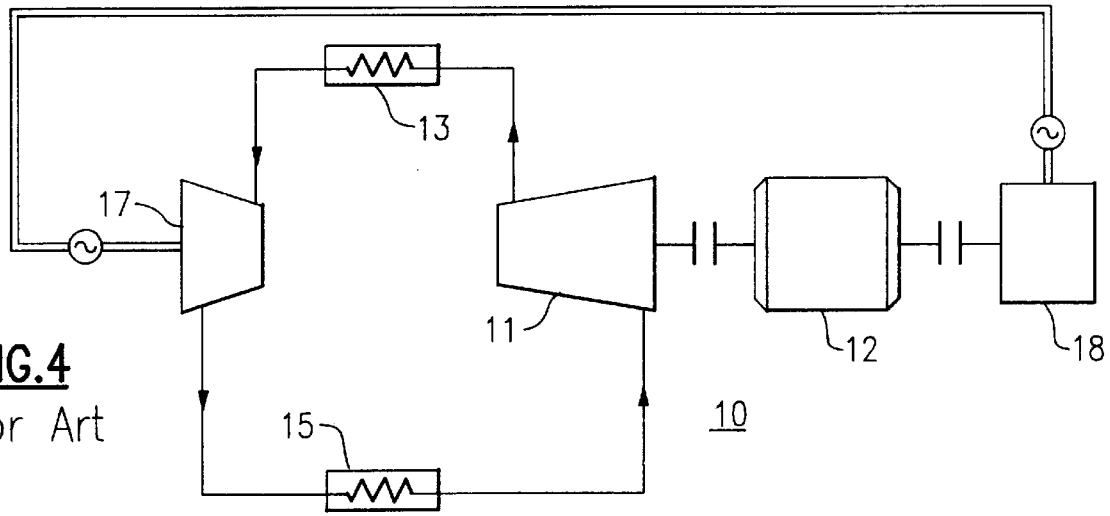
FIG.4 Prior Art
FIG. 4 is a schematic diagram of the known systems of FIGS. 1 and 3 using a turbo-expander which is electrically coupled to the main compressor.
Figure 5:
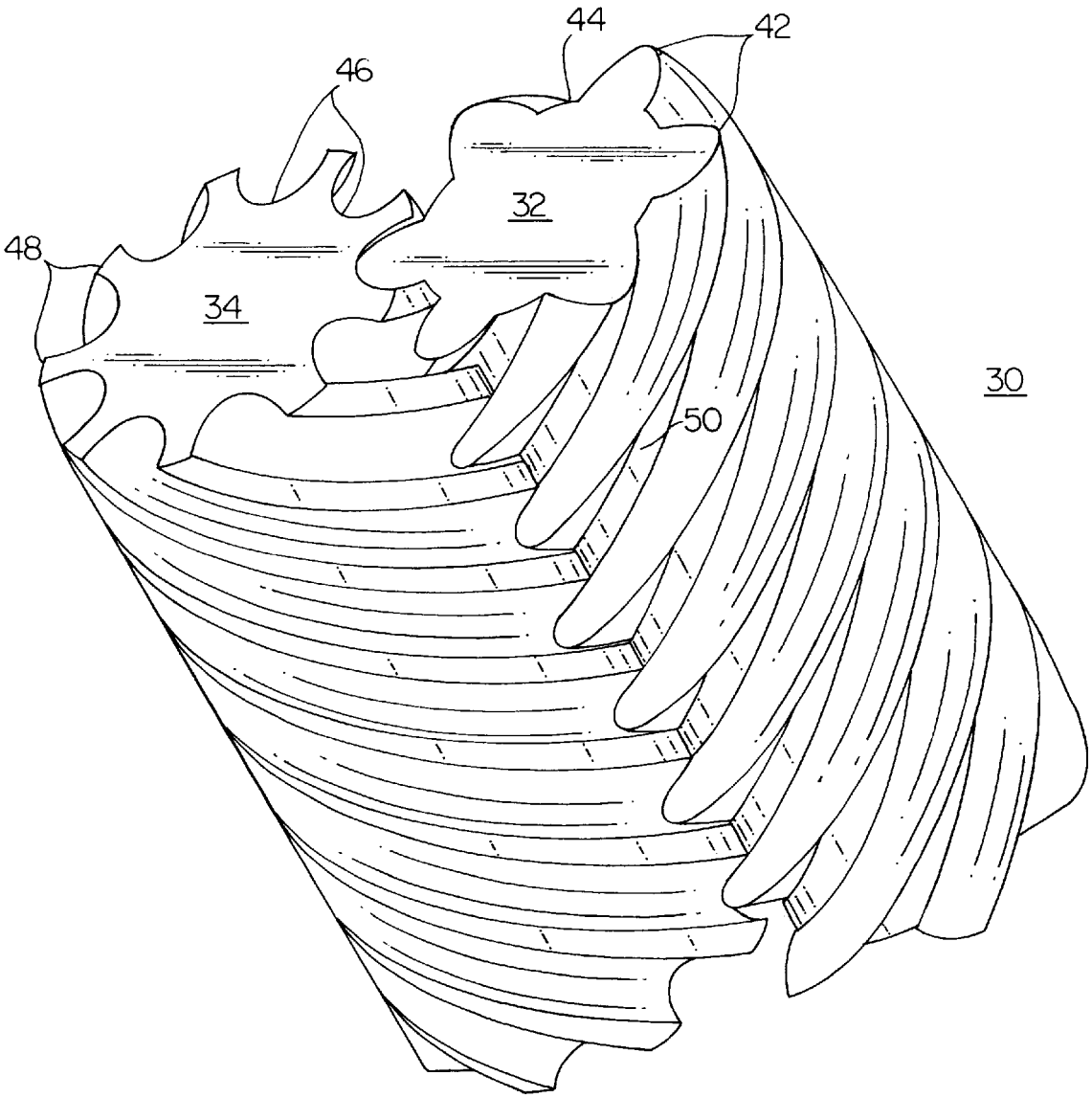
FIG. 5 is a partial perspective top view of a preferred embodiment of a positive displacement machine that expands in a first zone and compresses in a second zone.
Figure 6:
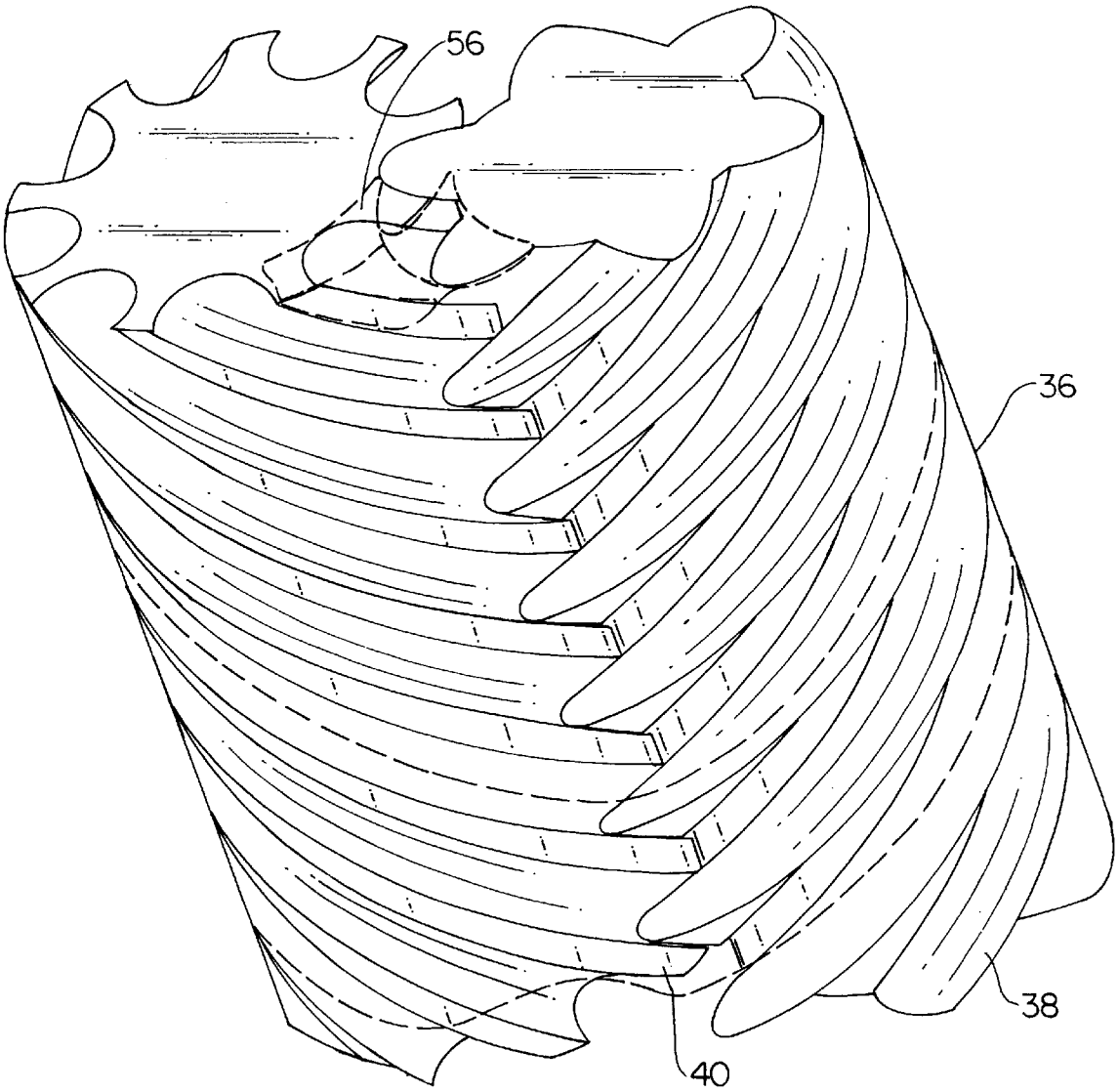
FIG. 6 is a perspective top view of the positive displacement machine of FIG. 5 showing the inlet port.
Figure 7:
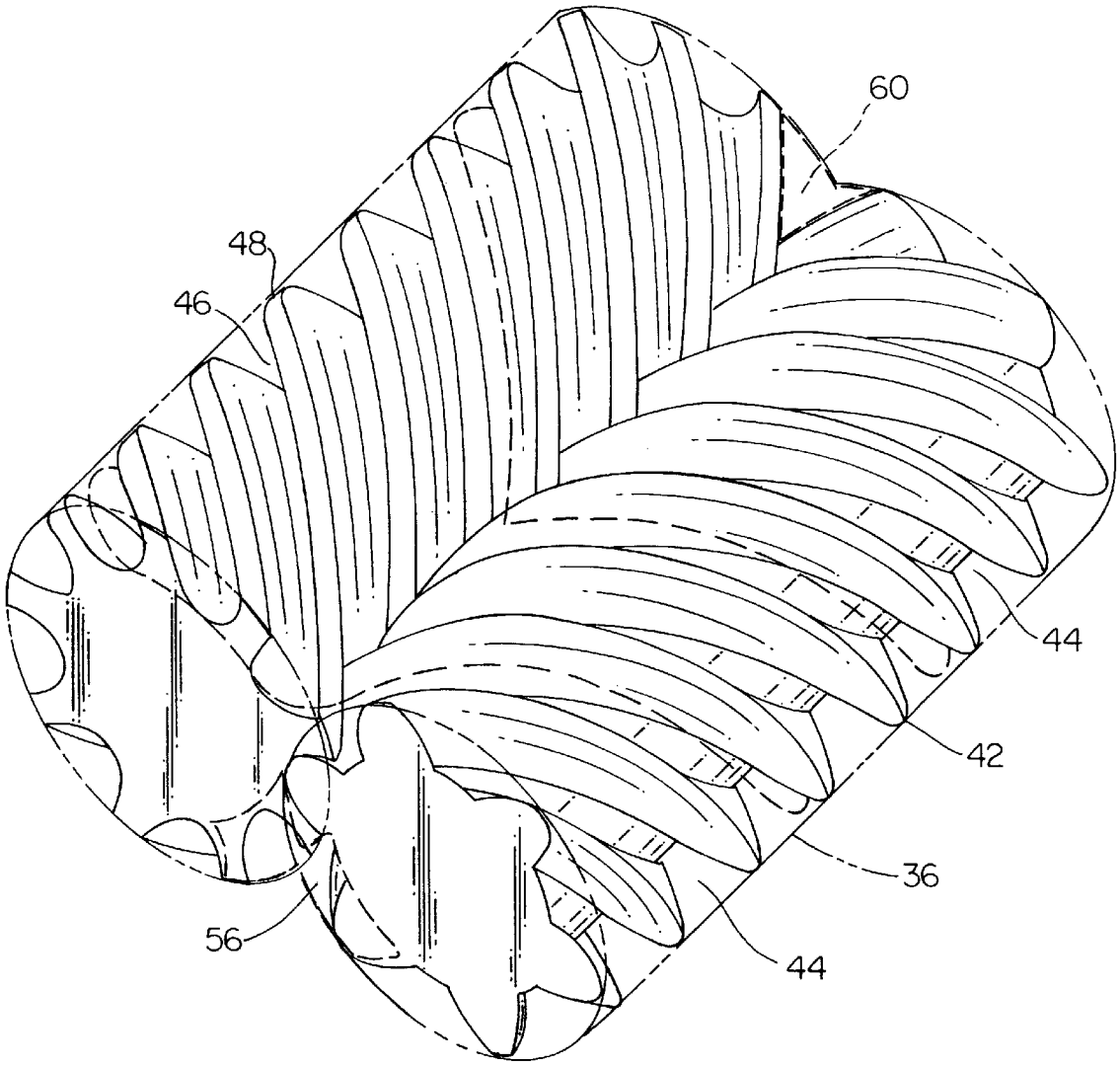
FIG. 7 is a partial perspective bottom view of the positive displacement machine of FIG. 5.
Figure 8:
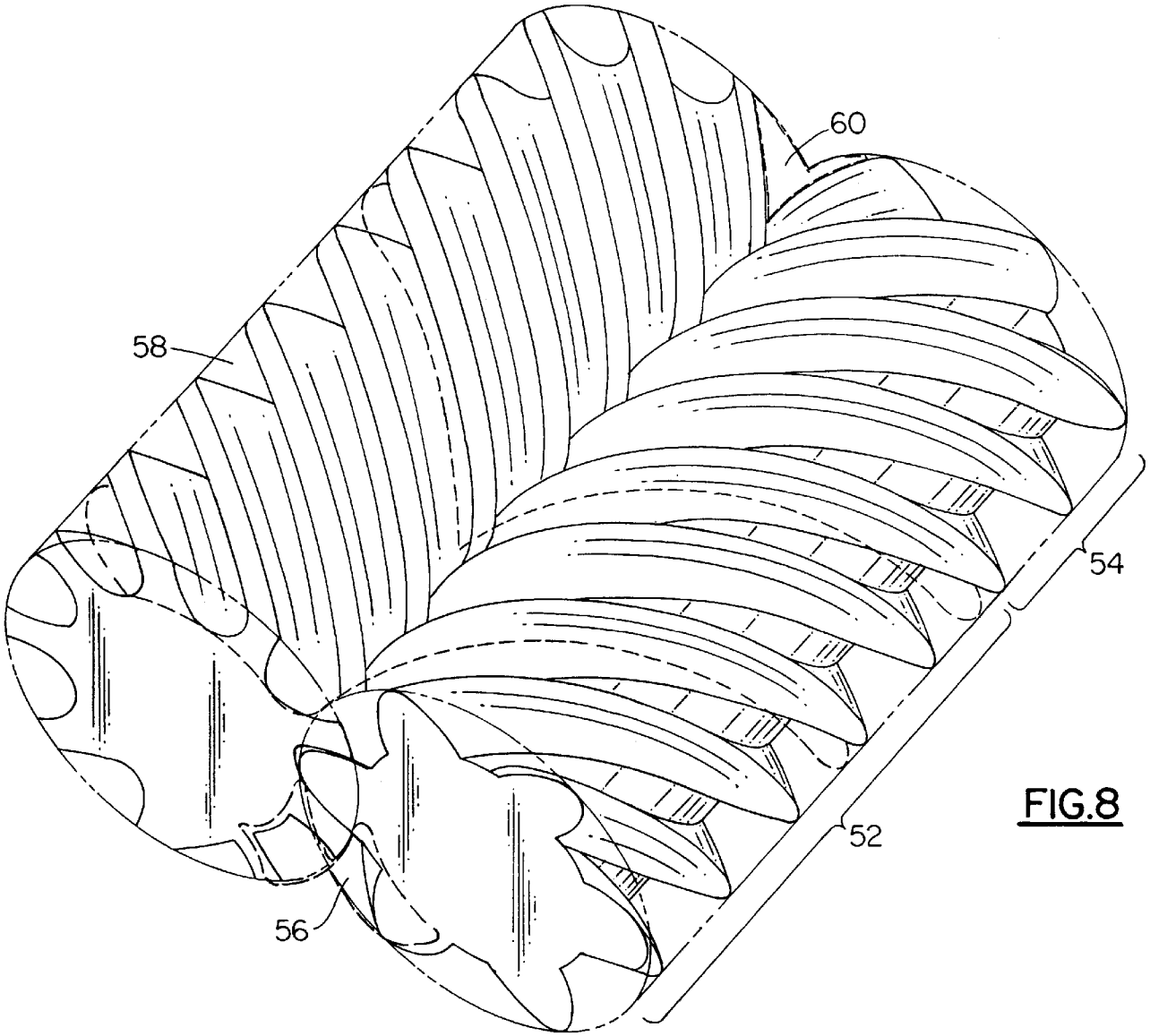
FIG. 8 is a perspective bottom view of the positive displacement machine of FIG. 5 showing the inlet, intermediate, and outlet ports.
Figure 9:
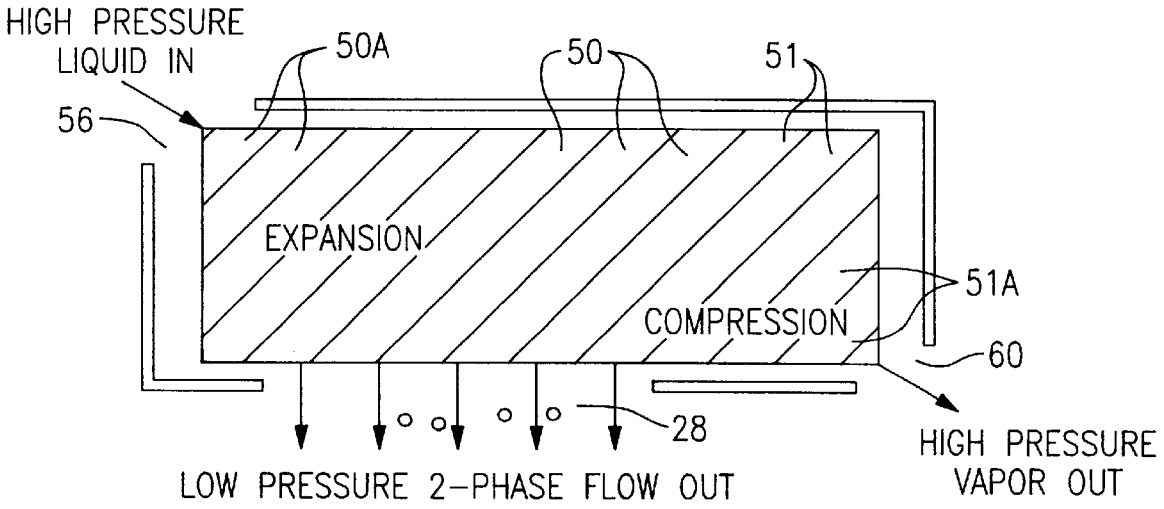
FIG. 9 is a side view of the positive displacement machine of FIG. 5 showing relative volumetric areas of the channeled volumes and the inlet, intermediate, and outlet ports.

The following discussion relates to certain preferred embodiments of the present invention. Throughout the course of discussion terms such as "front", "back", "side", "top", and "bottom" are used to provide a frame of reference in terms of the accompanying drawings. These terms, however, should not be construed as being limiting with regard to the inventive concepts conveyed.

Referring to FIGS. 5–9, there is shown a positive displacement machine, hereinafter referred to as an expressor 30, having a pair of engageable rotors, namely a first rotor 32 and a second rotor 34 disposed within the interior of a substantially sealed housing 36 having a volume substantially defined by intersecting first and second cylinders 38, 40. According to this embodiment, the first rotor 32 includes a plurality of helical lobes 42 disposed about a periphery thereof, separated by a corresponding plurality of grooves 44. The lobes 42 are sized to roughly correspond with the diameter of the first cylinder 38, while still allowing the first rotor 32 to rotate within the housing 36. The second rotor 34 includes a plurality of helical grooves 46, also disposed about the periphery thereof, and sized for receiving the helical lobes 42 of the first rotor 32. Between each of the helical grooves 46 are a corresponding number of lands 48 sized to roughly correspond with the diameter of the second cylinder 40, but still allowing the rotation of the second rotor 34 about a parallel axis of rotation as the first rotor 32. As each of the rotors rotate in opposing directions, the helical lobes 42 of the first rotor 32 are meshed with the helical grooves 46 of the second rotor 34.

The grooves 44, 46 of the meshing rotors 32, 34 and the inner wall of the housing 36 define channeled volumes 50, 50A, 51, 51A through which fluid refrigerant enters and subsequently passes. Two adjacent zones 52, 54 are defined along the axis of the expresser 30. The first zone is an effectively closed expanding working chamber or an expansion zone 52 defined by small channeled volumes 50A, 50 extending helically from an inlet port 56 of the expresser 30 that increase along the axis until the end of the expansion zone 52. The second zone is an effectively closed contracting working chamber or a recompression zone 54 and is defined by decreasing volumes of the channeled volumes 51, 51A. At the beginning of the recompression zone 54, there are large channeled volumes 51 which are adjacently disposed to the end of the expansion zone 52, the channeled volumes 51 of the recompression zone 54 decreasing until the outlet port 60 of the expressor 30 (also the end of the recompression zone). Therefore, the channeled volumes 50A, 51A in the front and rear of the expressor 30 are smaller than the intermediate channeled volumes 50, 51 of the expressor 30, shown representatively in FIG. 9.

At the top front portion of the expressor 30, the inlet port 56 is disposed for receiving a volumetric flow of fluid refrigerant, usually substantially of the liquid phase. As entering fluid refrigerant passes through the channeled volumes 50A, 50 of the expansion zone 52, the fluid will expand due to the volume increase thereof, resulting in added refrigerant vapor. The expansion of the fluid also causes flashing which performs work on the rotors 32, 34 when the trapped volume is increased in size. An intermediate port 58 is disposed in the bottom of the expressor 30 wherein substantially all of the liquid refrigerant is removed by centrifugal forces and gravity. The remaining fluid then passes into the second zone 54, where it is recompressed into a high pressure vapor due to the decreasing size of the channeled volumes 51, 51A. Resulting high pressure vapor then exits the expressor 30 through an outlet port 60 disposed in the bottom rear portion of the expressor 30. Therefore, both expansion and compression are accomplished using the same machine. The power recovered during the expansion process as rotational shaft energy is used directly to compress some of the vapor in the recompression zone of the expresser 30. The compression performed by the expressor 30 does not require external power input and is in addition to the compression performed by the main compressor. Therefore, the expresser 30 improves both efficiency and capacity of a given vapor compression system.

It is important that the overall axial length of the expressor 30 be long enough to remove substantially all of the liquid refrigerant through the intermediate port 58, but not so long as to negate the differences in the channeled volumes 50, 50A, 51, 51A, which would result in little recompression in the second zone 54. It is also important that the lobes 42 be shaped and configured to minimize fluid leakage between channels, such as through blowholes (not shown), in order for the fluid refrigerant to be efficiently expanded and/or compressed.

Figure 10:
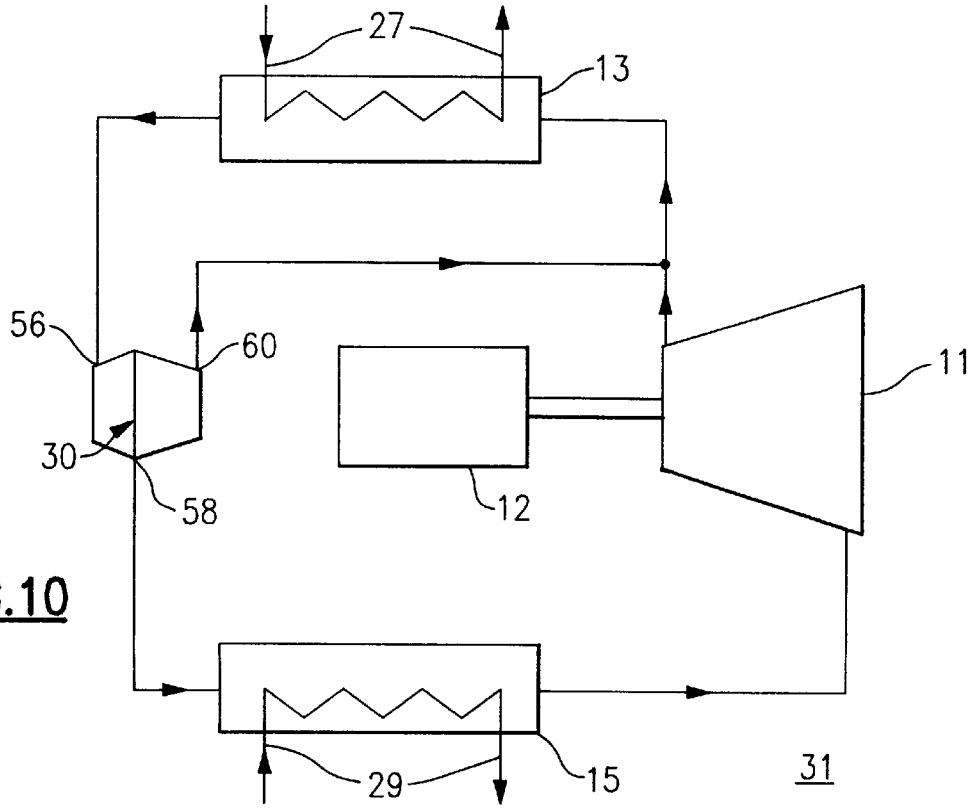
FIG. 10 is a schematic diagram of a chiller system employing the positive displacement machine of FIG. 5.
Figure 11:
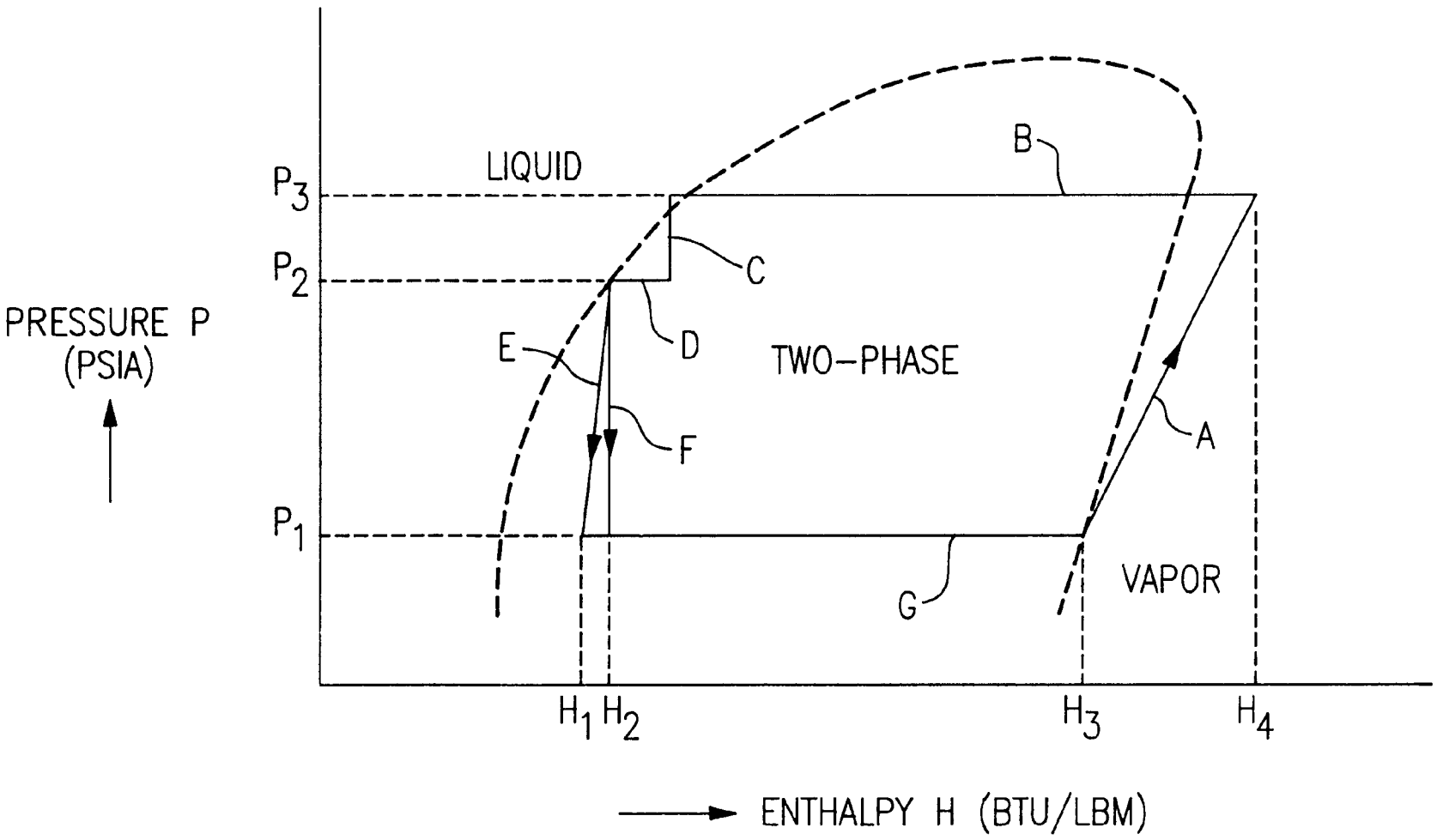
FIG. 11 is a refrigerant compression/expansion cycle chart for a system that employs an expresser such as the chiller system of FIG. 10.

Turning to FIGS. 10 and 11, there is shown a chiller system 31 having the described expressor 30 disposed between a condenser 13 and an evaporator 15. For the sake of clarity, those parts having the reference numerals as those described in FIGS. 1–9 will be identified with the same reference numerals. A low pressure ($P_1$) vapor refrigerant enters a compressor 11 where it is compressed into a high pressure ($P_3$) vapor refrigerant, represented by line A of FIG. 11. The high pressure vapor refrigerant then passes from the compressor 11 into the condenser 13, where it is cooled and condensed into liquid by heat exchange with liquid in a cooling circuit 27, represented by lines B, C and D of FIG. 11. Line C shows that once the refrigerant experiences a complete isobaric vapor-to-liquid phase change (line B) in the condenser 13, the refrigerant then undergoes an isoenthalpic pressure drop from $P_3$ to $P_2$ which causes the refrigerant to become a two-phase mixture once again at pressure $P_2$. While still in the condenser 13, the refrigerant undergoes another isobaric phase change to become substantially of the liquid phase at an enthalpy of $H_2$, as represented by line D. From the condenser 13, the refrigerant enters the expressor 30 through the inlet port 56. As previously described, the refrigerant expands thus forming a two-phase fluid mixture. Substantially all of the liquid refrigerant is forced from the expressor 30 through the intermediate port 58 and proceeds to the evaporator 15, represented by line E. The remaining refrigerant in the expresser 30 is recompressed (to the condenser pressure) in the recompression zone 54 and then exits the expressor 30 through the outlet port 60 in the form of a high pressure vapor, which is then fed back into the condenser 13.

Still referring to FIGS. 10 and 11, line F depicts the thermodynamic result of a throttling valve (not shown), while line E shows the thermodynamic result of the expansion zone 52 of the expressor 30. It should be apparent that there is a higher percentage of liquid in the refrigerant entering the evaporator 15 as a result of the fluid being expanded in the expressor 30 rather than in a throttling valve. The difference in enthalpy ($H_2$–$H_1$), due to a higher liquid concentration in the refrigerant, is the mechanical energy that is recovered during expansion, which is to be used by the rotor shafts of the expressor 30 during recompression. At the evaporator, the low-pressure substantially liquid refrigerant removes heat from a chilling circuit 29 and changes phase into a low-pressure substantially vapor refrigerant to be fed back into the compressor 11, represented by line G. By increasing the percentage of liquid of the refrigerant in the evaporator, the overall efficiency of the chiller system 31 is increased because more heat from the environment is required to change the phase and temperature of the refrigerant in the evaporator than to simply change the temperature of the refrigerant. As a result, the expressor 30 functions to increase the ratio of liquid to vapor of the refrigerant in the evaporator 15 and also functions to assist the compressor 11 by providing additional high pressure vapor to be condensed in the condenser 13.

Figure 12:
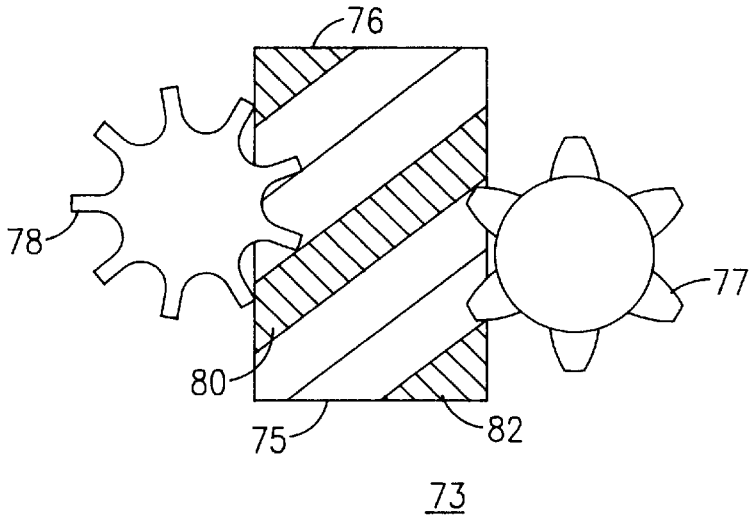
FIG. 12 is a partial side view of a positive displacement machine according to another preferred embodiment of the invention.

FIG. 12 shows an alternative embodiment of a positive displacement machine 73 according to the present invention including a first rotor 75 having a rotational axis which is perpendicularly disposed relative to a pair of meshing gate rotors 77, 78. Fluid refrigerant entering the plural displacement machine 73 through an inlet port 76 expands in first rotor 75 and becomes a two-phase mixture. After expansion in the first rotor 75, the liquid portion of the expanded refrigerant exits the first rotor 75 via an intermediate port 80. The remaining refrigerant vapor is then compressed and exits rotor 75 through an outlet port 82.

Figure 13:
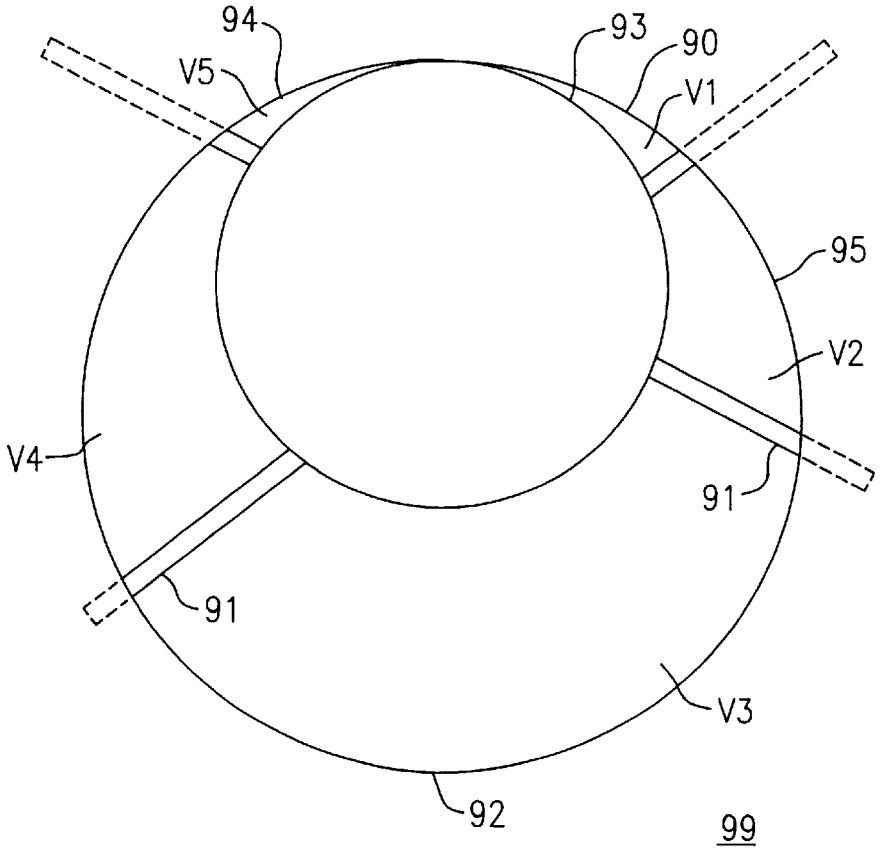
FIG. 13 is a partial end view of a rotary-vane expressor according to yet another preferred embodiment of the invention.

Yet another embodiment of the present invention is shown in FIG. 13, in which a rotary-vane expressor 99 includes a central rotor 93 eccentrically mounted in a cylindrical housing 95. A plurality of sliding vanes 91 are radially disposed on the exterior surface of the central rotor 93. As the central rotor 93 rotates along the inner surface of the housing 95, the sliding vanes 91 move radially into and out of circumferentially spaced passages 100 that are disposed in the housing 95, thereby changing the volume of the refrigerant. A high pressure liquid refrigerant having a volume V1 enters the rotary-vane expresser 99 through an inlet port 90. As the rotor 93 rotates, the volume of the refrigerant expands up to volume V3 in which the refrigerant now exists as a low pressure two-phase mixture. At an intermediate port 92, a substantial amount of the liquid present in the low pressure two-phase mixture is removed from the expressor 99. The remaining refrigerant then undergoes a compression to a volume V5 where it is finally removed through an outlet port 94 as a high pressure vapor.

Other variations are possible. For example, three or more rotors can be placed in a parallel (not shown) configuration so that alternating helical lobes mesh with alternating helical grooves. In this arrangement, a plurality of inlet ports and/or outlet ports can be provided so that the refrigerant is evenly expanded and compressed.

Though the present invention has been described in terms of a single embodiment, it will be readily apparent to one of sufficient skill in the field that variations and modifications are possible which remain within the spirit and scope of the invention.

What is claimed:

1. A plural rotor displacement machine for expanding and compressing a refrigerant, said machine comprising:

a first rotor having a plurality of helical lobes disposed about a rotor periphery;

at least one second rotor in meshing contact with said first rotor and having a plurality of helical grooves disposed about at least one second rotor periphery for receiving the lobes of said first rotor during rotation of said rotors in opposite directions; and a housing defining a chamber enclosing the rotors and having an inlet port at one end and an outlet port at an opposite end;

said housing including an intermediate port formed in a side wall of said chamber between the inlet port and the outlet port and wherein said rotors and said housing define during rotation of said first rotor in one direction an effectively closed expanding working chamber between the inlet and intermediate ports and an effectively closed contracting working chamber between the intermediate and outlet ports.

2. A plural rotor displacement machine as recited in claim 1, wherein said rotors are caused to rotate by the receipt of a fluid mixture in said inlet port without use of a motor.

3. A plural rotor displacement machine as recited in claim 1, wherein said first and at least one second rotor are disposed in parallel relation with each other, each of said rotors having respective axes of rotation which are parallel.

4. A plural rotor displacement machine as recited in claim 3, wherein at least one rotor has an axis of rotation which is angled to the axes of rotation of the remaining rotors.

5. A plural rotor displacement machine as recited in claim 1, including a motor for causing at least one rotor to rotate.

6. A plural rotor displacement machine as recited in claim 1, wherein the expanding working chamber includes at least one channeled volume.

7. The plural rotor displacement machine as recited in claim 6, wherein said at least one channeled volume of the expanding working chamber increases in volume along the axis of the expanding working chamber.

8. The plural rotor displacement machine as recited in claim 1, wherein said expanding working chamber includes a length sufficient to allow expansion of said refrigerant and to remove substantially all of the liquid from said refrigerant.

9. The plural rotor displacement machine as recited in claim 1, wherein the contracting working chamber includes at least one channeled volume.

10. The plural rotor displacement machine as recited in claim 9, wherein said at least one channeled volume of the contracting working chamber decreases in volume along the axis of the contracting working chamber.

11. The plural rotor displacement machine as recited in claim 1, wherein said first and second rotors include a length sufficient to perform both expansion and compression of said refrigerant.

12. A single fluid compression/expansion refrigeration apparatus which comprises:

a fill of fluid refrigerant that exists in the apparatus as liquid and a vapor;

a compressor for compressing the fluid refrigerant thereby adding compression energy to the refrigerant fluid, said compressor having an inlet to receive said fluid at a predetermined reduced pressure and an outlet from which the fluid is delivered at an elevated pressure;

a drive motor coupled to said main compressor for driving said main compressor;

condenser means for extracting heat from the refrigerant thus converting the compressed vapor emerging from said main compressor into a liquid;

evaporator means for absorbing external heat into the refrigerant and for converting liquid refrigerant into vapor; and a plural rotary displacement machine disposed between said condenser means and an input to said evaporator means, said plural displacement machine comprising:

a first rotor having a plurality of helical lobes disposed about a rotor periphery;

at least one second rotor in meshing contact with said first rotor and having a plurality of helical grooves disposed about a rotor periphery for receiving the lobes of said first rotor during rotation of said rotors in opposite directions; and a housing defining a chamber enclosing the rotors and having an inlet port at one end and an outlet port at an opposite end;

said housing including an intermediate port formed in a side wall of said chamber between the inlet port and the outlet port and wherein said rotors and said housing define during rotation of said first rotor in one direction an effectively closed expanding working chamber between the inlet and intermediate ports and an effectively closed contracting working chamber between said intermediate ports and said outlet port.

13. The refrigeration apparatus as recited in claim 12, wherein said rotors are caused to rotate by the receipt of a fluid mixture in said inlet port without use of a motor.

14. The refrigeration apparatus as recited in claim 12, wherein said first and at least one second rotor are disposed in parallel relation with each other, each of said rotors having respective axes of rotation which are parallel.

15. The refrigeration apparatus as recited in claim 14, wherein at least one rotor has an axis of rotation which is angled to the axes of rotation of the remaining rotors.

16. The refrigeration apparatus as recited in claim 12, including a motor for causing at least one rotor to rotate.

17. The refrigeration apparatus as recited in claim 12, wherein the expanding working chamber includes at least one channeled volume.

18. The refrigeration apparatus as recited in claim 17, wherein said at least one channeled volume of the expanding working chamber increases in volume along the axis of the expanding working chamber.

19. The refrigeration apparatus as recited in claim 18, wherein the contracting working chamber includes at least one channeled volume.

20. The refrigeration apparatus as recited in claim 18, wherein said at least one channeled volume of the contracting working chamber decreases in volume along the axis of the contracting working chamber.

21. A positive displacement machine comprising:

a cylindrical housing having a plurality of circumferentially spaced passages;

a rotor having an exterior surface eccentrically disposed within said cylindrical housing, said rotor being sized to allow eccentric rotation of said rotor within said housing; and a plurality of sliding vanes disposed in contact with the exterior surface of said rotor, said vanes being radially slidable through the passages of said housing such that said vanes, said rotor and said housing define a plurality of circumferentially spaced volumes, said housing including an inlet port, an outlet port, and an intermediate port disposed between the inlet and outlet ports, the inlet port disposed at a first spaced volume in the direction of rotation of said rotor, said inlet port being defined by said rotor, said housing, and a single sliding vane, the intermediate port disposed at a second spaced volume, said intermediate port being defined by said rotor, said housing and two sliding vanes, the outlet port disposed at a second spaced volume away from the direction of rotation of said rotor, said outlet port being defined by said rotor, said housing, and a single sliding vane.

* * * * *